US006935522B1

(12) United States Patent
Mileaf

(10) Patent No.: US 6,935,522 B1
(45) Date of Patent: Aug. 30, 2005

(54) FLAT MAIL CARRIER AND PROCESSING AID

(75) Inventor: Daryl S. Mileaf, Hanover, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 297 days.

(21) Appl. No.: 10/167,482

(22) Filed: Jun. 13, 2002

(51) Int. Cl.[7] ..... A47F 7/00
(52) U.S. Cl. ..... 211/189; 211/50; 211/49.1; 209/900; 100/34
(58) Field of Search ..... 211/50, 49.1, 10, 211/189; 206/442, 554; 209/900; 100/34

(56) References Cited

U.S. PATENT DOCUMENTS

| | | | | |
|---|---|---|---|---|
| 1,096,356 A | * | 5/1914 | Downey | 211/50 |
| D170,309 S | * | 9/1953 | Curtis et al. | D6/475 |
| 3,038,403 A | * | 6/1962 | Orelind | 100/34 |
| 4,161,092 A | | 7/1979 | Buday et al. | |
| 4,684,163 A | * | 8/1987 | Anderson | 294/149 |
| 4,699,277 A | | 10/1987 | Baxter | |
| 4,732,279 A | * | 3/1988 | Gurkin | 209/702 |
| 4,817,260 A | * | 4/1989 | Martin | 29/426.6 |
| 4,889,397 A | * | 12/1989 | Ryan | 312/332.1 |
| 5,005,709 A | * | 4/1991 | Stokes | 211/50 |
| 5,388,506 A | * | 2/1995 | Vargas et al. | 100/34 |
| 5,533,318 A | * | 7/1996 | Murat | 53/390 |
| 5,868,066 A | * | 2/1999 | Maher | 100/34 |
| 6,241,099 B1 | | 6/2001 | Hendrickson et al. | |

FOREIGN PATENT DOCUMENTS

| | | |
|---|---|---|
| DE | 12 36 471 | 3/1997 |
| DE | 200 04 017 U1 | 2/2001 |
| FR | 2 690 325 | 10/1993 |

OTHER PUBLICATIONS

Copy to PCT Notification of Transmittal of The International Search Report or the Declaration with PCT International Search Report.

* cited by examiner

*Primary Examiner*—Robert W. Gibson, Jr.
(74) *Attorney, Agent, or Firm*—Birch, Stewart, Kolasch & Birch, LLP

(57) ABSTRACT

Pre-packaging of flats mail by mailers, printers, and binding houses is provided by a carrier assembly that provides optimum shipping volumes while requiring reduced handling at postal facilities at elevated rates while supporting both manual and automated mail processing. The carrier assembly consists of a substantially rigid carrier body of rectangular cross section and includes a plurality, at least two, of generally flat, rectangular side walls and at least one end wall, two or more of which have one or a pair of banding guide slots formed in respective outer edges thereof in mutual registration for receiving banding or other strapping means in either parallel or cross-banding arrangements for securing mail loaded therein.

7 Claims, 5 Drawing Sheets

FLAT MAIL CARRIER AND PROCESSING AID

BACKGROUND OF THE INVENTION

1. Field of the Invention

This invention relates generally to apparatus for handling mail in postal facilities and, more particularly, to a mail carrier device for providing reduced handling of flat mail at postal facilities while supporting both manual and automated mail processing.

2. Description of Related Art

The United States Postal Service (USPS) allows the mailing industry to prepare mail in a number of formats and sequences. Typically, flat mail is prepared in bundles. Bundles are created to allow mail that is destined for the same carrier route or zoned to be processed concurrently. There are a number of preparation schemes that mailers can use, and each scheme has a mailing cost associated with it.

The following is an example of some of the various ways mailers can prepare bundles of flats mail: (a) 3-digit mail—where all mail in the bundle, or mailing, is going to a 3-digit postal zone. This refers to the first three digits of a zip code, e.g., 210xx. The mail within the bundle will be distributed to a number of facilities in carrier routes within that zone; (b) 5-digit mail—where all mail within the bundle is going to a 5-digit zone. Most likely, the mail within the bundle will be distributed within a single post office delivery unit, e.g., 21076 which is the zip code for the post office in Hanover, Md., U.S.A.; (c) Carrier route mail where a carrier route number contains mail for a specific carrier within a 5-digit zone; and, (d) Line-of-travel (LOT) and/or carrier sequenced mail where bundles of LOT or carrier sequence mail have been prepared such that the mail within the bundles is in a sequence for a specific carrier within a zone. LOT mail contains mail in either ascending or descending order for addresses on streets in a close proximation of how the carrier actually will deliver the mail. Carrier sequence mail is prepared in exactly the sequence that the carrier delivers the mail.

Each of the above-mentioned preparation standards are processed differently and has an associated processing cost. 3-digit mail is usually cross-docked through postal facilities as a bundle until it arrives at the processing center that serves the 3-digit zone. The bundle is then opened and processed to a 5-digit level and delivered to the Post Office that serves that 5-digit zone. 5-digit bundles are cross-docked all the way to the processing center that serves the 5-digit zone. Depending on the processing center operations, the bundle may be delivered to the local Post Office that delivers the mail or may be processed then to a carrier level where the mail is separated to the carrier within the delivery office without the need for separation. Carrier route, LOT and carrier sequence mail are all cross-docked directly to the local Post Office that delivers the mail.

In all cases, the local carrier then sequences or "cases" the mail for delivery wherein the mail is ordered in the sequence that the carrier will deliver on his/her route. These mailing standards and incentives are based on a large part on the principle that the carrier will case mail at the delivery unit and the mail has been tailored to account for automation and mechanization used in postal facilities to route the mail through the postal network.

Recently, automation capabilities have been introduced into postal networks that have enabled the application of new paradigms. Specifically, the use of high speed flats automation and the development of automated sequence equipment have enabled the USPS to consider moving the majority of delivery unit mail handling into the processing centers remote from the local delivery office. In this new paradigm, mail would be processed to either carrier level or completely sequenced at carrier level before it arrives at the local delivery office. This approach removes the majority of manual labor currently involved in preparing the mail for delivery and thus allow the delivery offices to run more efficiently.

In parallel with these developments, the use of high speed automation has increased the demand of mail on system feeders. The USPS Automated Flat Sorting Machine 100 (AFSM 100) has three high-speed feeders which output 7200 pieces of mail per hour. Operation experience has shown that this demand is challenging for operators to meet. The operators are required to place approximately 12 inches of mail onto a feeder per minute. Mail must also be placed in proper orientation, with the binding down and the mailing label facing the right and "groom" the mail to ensure proper system operation. In order to reduce the requirements on feeder operators, USPS prepares mail for processing on this machinery. Typically, flats mail bundles are opened where they are strapped and/or shrink-wrapped and placed in carts in an orientation with binding and labels all facing the same directions. This frees system operators from the task of unbundling and orienting mail during feeding operations. While this set of tasks does not allow operators to keep pace with the system demands, it does introduce additional cost to the overall operation.

The next generation of flats mail processing equipment will run at approximately twice the speed of the current state of the art, i.e., 10,000–12,000 pieces per hour for each feeder. These systems will run faster than operators can manually feed them. These speeds are necessary to provide a required through-put to enable multi-high passing sequencing. The approximate, effective through-put of a multi-pass system is the running through-put divided by the number of passes. Currently, two-pass, multi feeder operations are being developed to sequence flat mail. Higher through-puts are required on these multi-pass systems to enable them to process, i.e. case the mail within the delivery time constraints for the various mail classes. Effectively, this requires the systems to run faster than operators can manually load systems within the current operational and technological constraints. This also creates an elevated requirement for mail preparation, i.e., the mail must be prepared faster. Because these preparation operations are manually intensive, this creates additional costs in the overall cost of operation offsetting a portion of the savings created by the processing/sequencing operations.

SUMMARY

Accordingly, it is the primary object of the present invention to allow for pre-packaging of flats mail by mailers, printers, and binding houses in a manner that provides optimum shipping volumes while requiring reduced handling at postal facilities at elevated rates while supporting both manual and automated mail processing.

This is achieved by a system for pre-packaging and transporting flat mail with a mail carrier assembly that interfaces directly and seamlessly with material handling systems and automation equipment and thus allows mail to be packaged in quantities that meet the processing speeds of current and future sorting technologies and thus the system will streamline mail handling operations while eliminating in facility preparation costs and reducing the demand for manual loading of system feeders.

Such a carrier in its broadest aspect comprises a substantially rigid carrier body having a rectangular cross section and including a plurality, at least two generally flat, rectangular side walls and at least one end wall or plate, two or more of which have banding guide slots formed in respective outer edges thereof in mutual alignment for receiving banding or other strapping means in either parallel or cross-banding arrangements for securing mail loaded therein.

Further scope of applicability of the present invention will become apparent from the detailed description provided hereinafter. It should be understood, however, that the detailed description and specific examples, while disclosing preferred embodiments of the invention, they are provided by way of illustration only, since various changes and modifications coming within the spirit and scope of the invention will become apparent to those skilled in the art.

BRIEF DESCRIPTION OF THE DRAWINGS

The present invention will become more fully understood from the detailed description provided hereinafter when considered in conjunction with the accompanying drawings, and wherein.

DESCRIPTION OF THE PREFERRED EMBODIMENTS

This invention is directed to a flats mail carrier that removes the need for mail preparation, interfaces with automation equipment, and allows the mailers and the USPS to prepare flat mail for streamlined processing operations including high speed sorting and sequencing, both single and multi-pass sequencing. In brief, this invention allows operators to load more mail, more efficiently onto system feeders. Additionally, mail may be prepared by the mailers in such a manner so as to enable the USPS to take the product directly from the incoming docks to processing equipment.

The flats mail carrier according to this invention fulfills several needs, namely: (a) it has an open or openable end for moving mail lengthwise out of the carrier to a feed bed of an automatic mail processing system; (b) it has the capability for both manual and auto unloading of flats mail loaded into the carrier; (c) it is able to attain a fixed position relative to the input of a mail feeder associated with the automatic processing system; and, (d) it includes at least one banding guide slot in mutual alignment with an orthogonally adjacent wall member.

Figure 1:
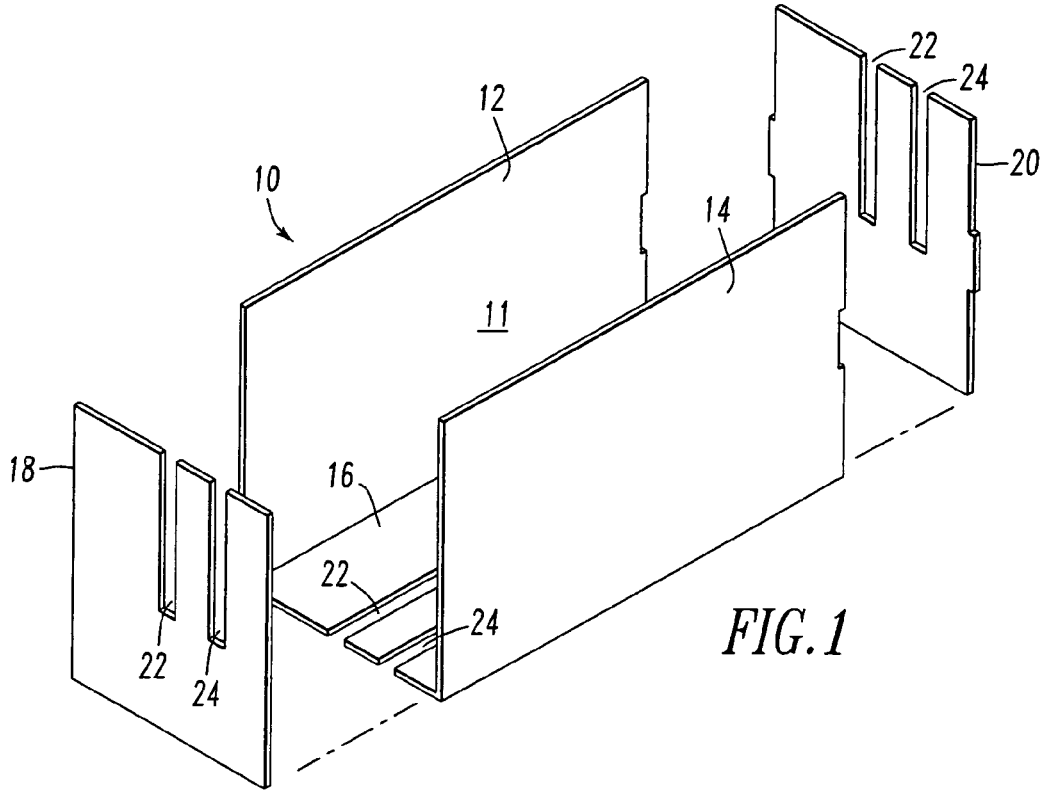
FIG. 1 is an exploded perspective view illustrative of a U-shaped carrier with a fixed end plate, translational or movable end plate, and banding guide slots in accordance with a first embodiment of the invention.
Figure 2:
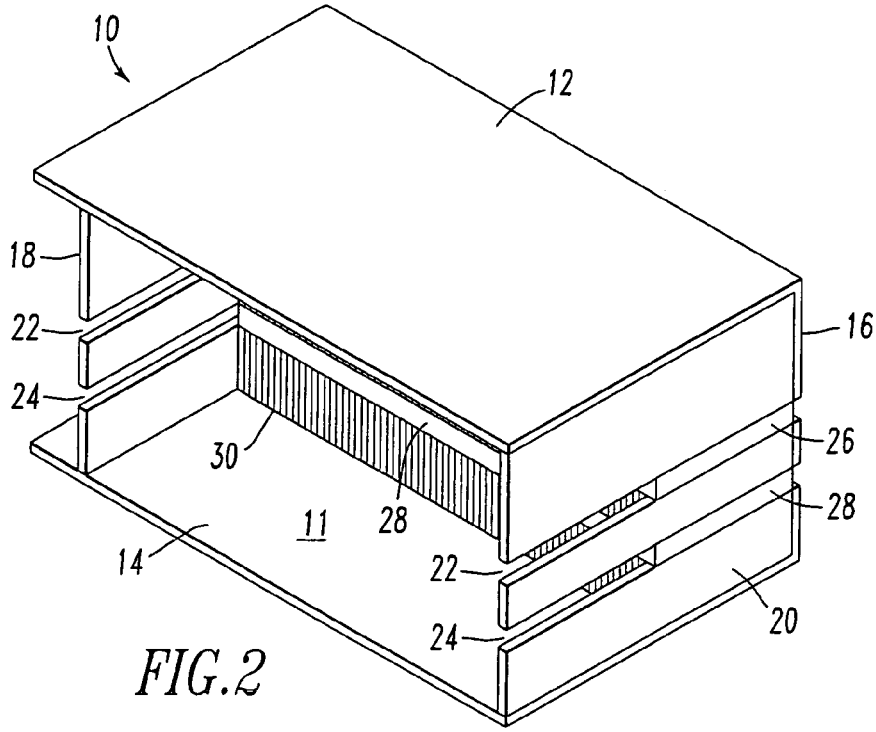
FIG. 2 is a perspective view of the carrier shown in FIG. 1 with a stack of flat mail loaded therein and secured by a pair of banding or strapping elements.

Referring now to the drawing figures wherein like reference numerals refer to like parts throughout, and particularly to FIGS. 1 and 2, shown thereat is a first embodiment of the invention comprised of a flats mail carrier 10 including a U-shaped three sided body portion 11 having a pair of opposing generally flat, rectangular side walls 12 and 14 and an adjoining third wall 16. The carrier also includes a pair of end walls or plates 18 and 20, one of which 18 comprises a movable end plate within the body portion 11 as shown in FIG. 2, while the opposite end plate 20 is fixed to edges of the side walls 12, 14 and 16. Further as shown in FIGS. 1 and 2, the wall 16 and the end plates 18 and 20 each include a pair of banding guides or slots 22 and 24 which are mutually aligned for receiving one or two parallel banding elements or straps 26 and 28 shown in FIG. 2, for example, for holding a stack 30 of flat mail in place when loaded therein.

The banding guides or slots 22 and 24 are located so as to accommodate different sized mail so that the banding elements or straps 26, 28 contact and constrain the stack 30 of flat mail at or near the mid section thereof and also to accommodate multiple stacks of smaller mail pieces relative to the size of the end plates 18 and 20. For example, the slots 22 are located so as to be substantially centered in the end plates 18 and 28 as well as the wall 16, while the slots 24 are off centered approximately one third of the way in from the outer edges thereof. It should be noted that the end plates 18 and 20 including the banding slots 22 and 24 provide product stability and hold the stack 30 of flat mail product in place, and can be either integral with or separate components of the carrier assembly.

Figure 3:
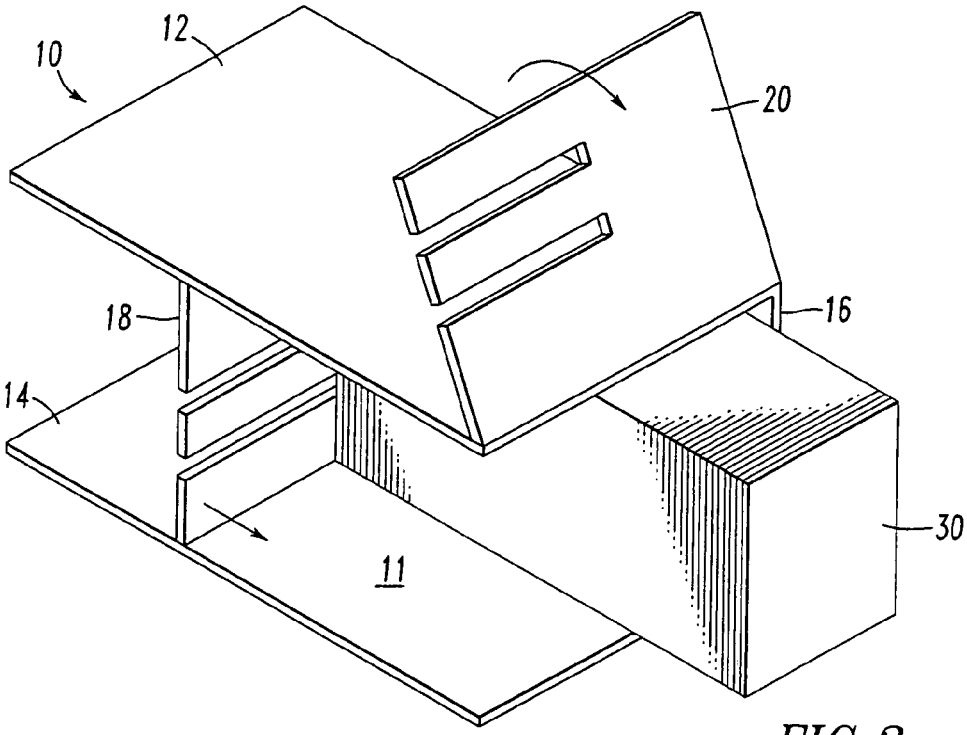
FIG. 3 is a perspective view of a U-shaped carrier of a second embodiment of the invention, similar to that shown in FIGS. 1 and 2, where the carrier includes a fixed, hinged end plate and a removable end plate.
Figure 4:
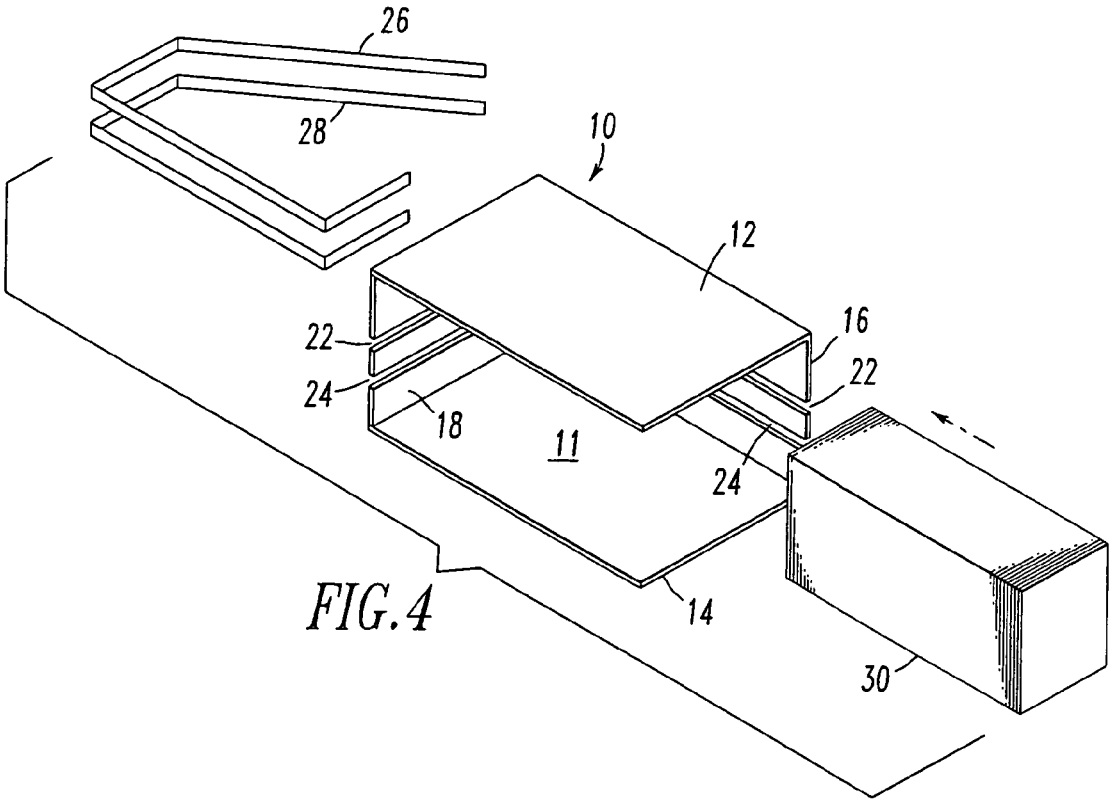
FIG. 4 is an exploded perspective view illustrative of a U-shaped carrier in accordance with a third embodiment of the invention, having banding guide slots, a fixed end plate and an open opposite end devoid of an end plate for the passage of a flats mail bundle.

Further, as shown in FIG. 3, the end plate 20 is hinged to the side wall 12 rather than being fixed as shown in FIG. 2. In FIG. 4, the end plate 18 is fixed by being attached to the side walls 12, 14 and 16, while the opposite end plate 20 is deleted, leaving an open-ended carrier assembly. As to FIGS. 5 and 6, shown thereat are two embodiments of a three-sided carrier body 11 having one open end and comprises the simplest embodiments of a flat mail carrier according to the subject invention.

Figure 5:
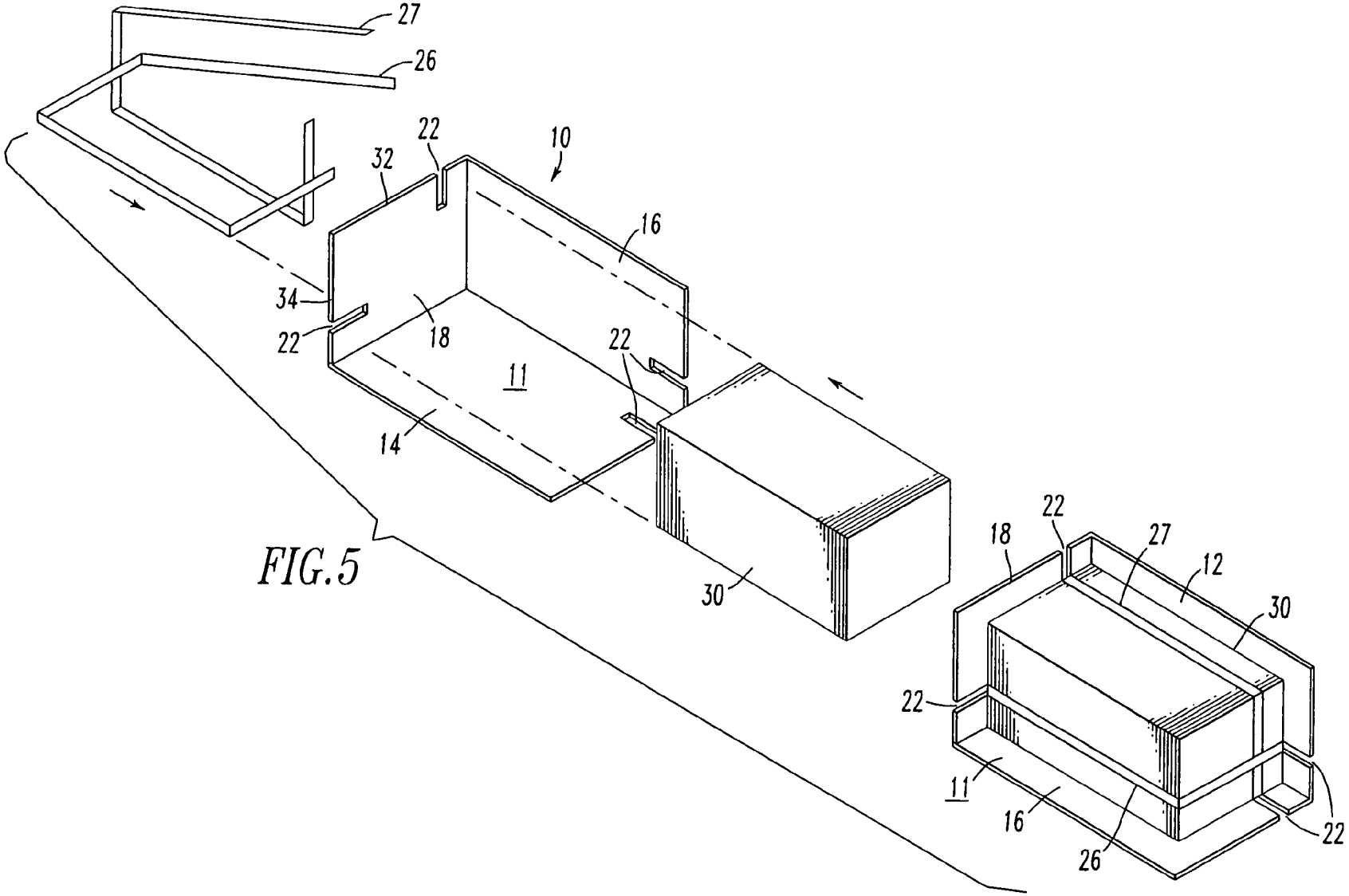
FIG. 5 is an exploded perspective view of a three-sided carrier with cross-banding guide slots for receiving mutually orthogonal banding members in accordance with a fourth embodiment of the invention.

Referring now to FIG. 5, the carrier body 11 is comprised of three mutually orthogonal wall members 14, 16 and 18. Wall 12 is now deleted. The walls 14 and 16 include single offset banding slots 22, while the end wall or plate 18 includes two offset banding guide slots 22 located in mutually orthogonal edges 32 and 34 of the back plate 18. The banding slots 22 are provided to accommodate a cross-banding arrangement consisting of banding or strapping elements 26 and 27, as shown in the upper left-hand portion of FIG. 5.

Figure 6:
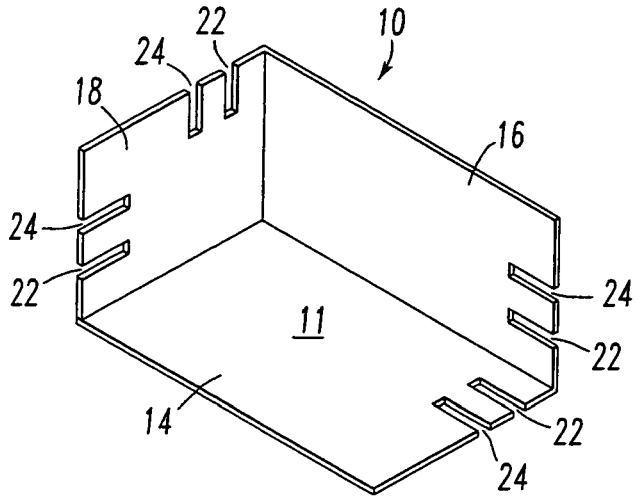
FIG. 6 is a perspective view of a three-sided carrier similar to that shown in FIG. 4, but having pairs of cross-banding guide slots for receiving mutually orthogonal banding members in accordance with a fifth embodiment of the invention.
Figure 7:
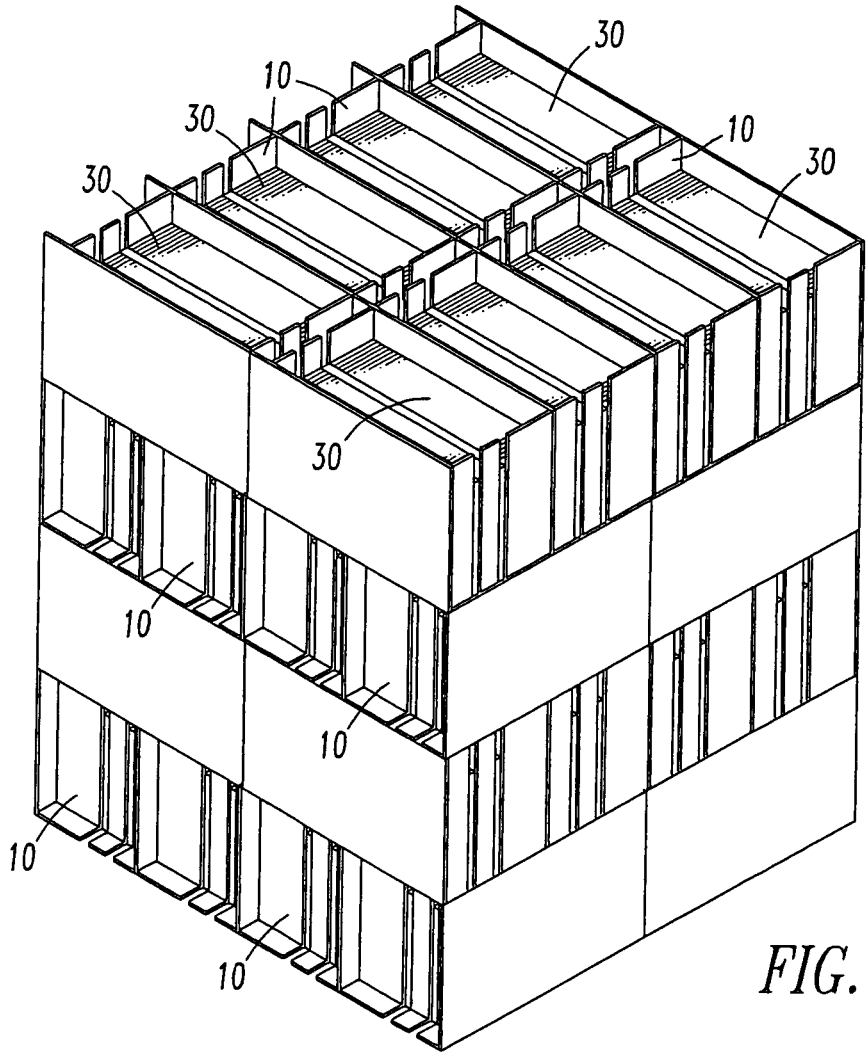
FIG. 7 is a perspective view of an assembly of palletized carriers in accordance with the embodiments shown in FIGS. 1–5.

The configuration of FIG. 6 includes the same generally rectangular side walls 14 and 16, and a single fixed end wall or plate 18 as shown in FIG. 5, the only difference being that pairs of banding slots 22 and 24 are included in the outer edges of the wall members so as to accommodate either single or double banding arrangements in either direction as needed.

Figure 8:
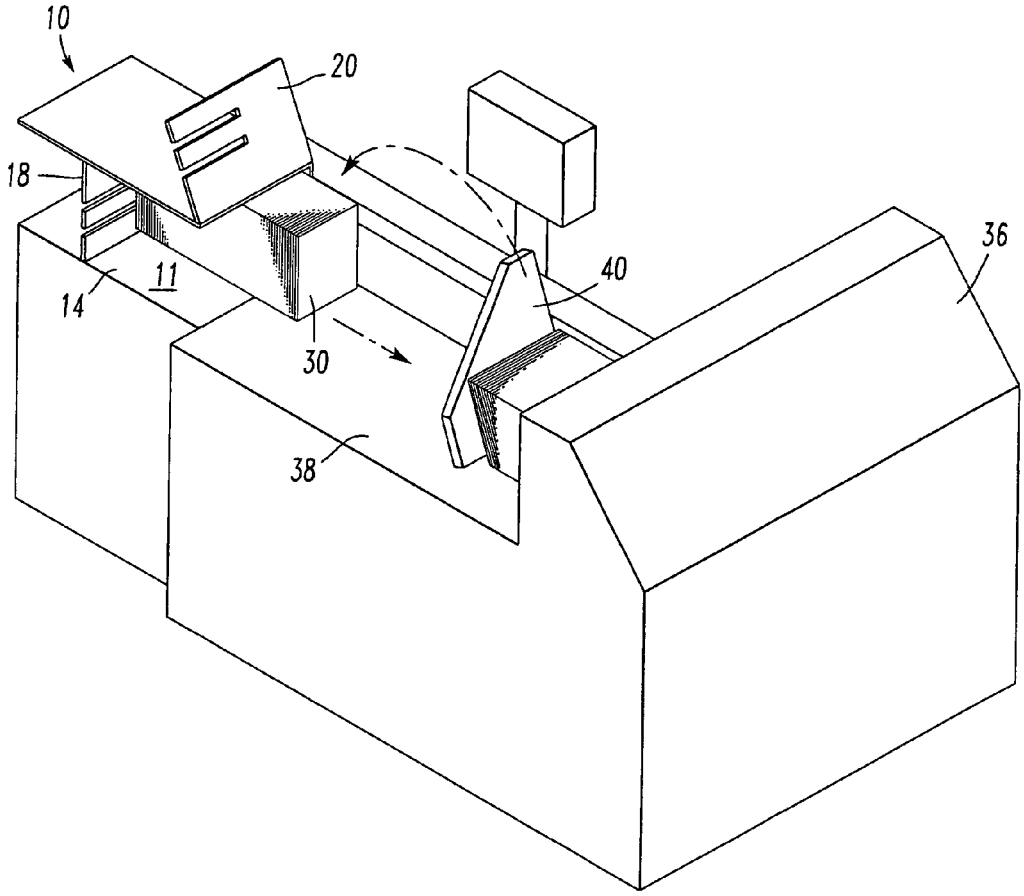
FIG. 8 is a perspective view of a mail feeder system for receiving flats mail unloaded from a carrier assembly shown in FIG. 2, located on the feeder bed thereof.

It should be noted that the carriers 10 shown in the various embodiments can be sized to allow mailers to pre-package mailings up to 48 inches in length and any mail piece geometry. Mail is loaded into the carriers and banding is applied using the fixed or free end plates 18 and 20. The stability provided by this system allows mailers to prepare mail in larger quantities than traditional bundles oriented properly for direct loading onto systems. The carrier bodies 11 can be manufactured from any desirable thin, flat, disposable, recyclable, or reusable material or even sheet metal. The carriers 10 can be palletized as shown in FIG. 6 in any of the traditional industry standard methods and patterns for shipping or shipped by any other means. The carriers 10 can also be designed to include features for interfacing to both lifting equipment and system feeders for either semi-automated or completed automated handling equipment. For example, at a USPS processing facility carriers 10, such as shown in FIG. 3, can be de-palletized and delivered directly to processing equipment such as a feeder assembly 36 which forms a portion of a flats bundle collator system shown and described in the subject assignee's U.S. Pat. No. 6,241,009, entitled "Flats Bundle Collator" Hendrickson et al., issued on Jun. 5, 2001, and which is incorporated herein by reference. As shown in FIG. 8, when the body 11 of carrier 10 is placed on a feeder bed 38 following removal of banding elements, mail in the flats mail stack 30 is unloaded, for example by use of a manually operated paddle 40 which is used to move mail into the feeder 36.

Thus what has been shown and described is a flat mail carrier of various design concepts which provide both the means of packaging and shipping product and while providing a vehicle to interface directly to the system feeders. This systematic approach eliminates the need for mail to be unloaded, unbanded and prepared in trays, carts, or other means for system processing. The product, such as flats mail, can be routed directly to sorting systems from facility docks and loaded directly onto system feeders. The delivery of product to systems can be accomplished as full pallets or as individual carriers using a facility material handling system such as conveyors, tilt tray sorters, etc.

Thus mailers can prepare and package the mail such that full pallets can be staged until processing operations are scheduled rather than unloading upon arrival, preparing for processing prior to sorting processing. This allows incoming operations to separate the truck unloading operation from the pallet unloading operation where doing so may have an operation scheduling benefit.

The foregoing detailed description merely illustrates the principles of the invention. It will thus be appreciated that those skilled in the art will be able to devise various arrangements, which, although not explicitly described or shown herein, embody the principles of the invention and are thus within its spirit and scope.

What is claimed:

1. A mail carrier for providing reduced handling of mail at postal facilities while supporting both manual and automated mail processing, comprising:

a substantially rigid carrier body having a rectangular cross section and having a plurality of flat, generally rectangular mutually orthogonal wall members including three side walls and a pair of end walls, an intermediate side wall of said three side walls and said pair of end walls having a pair of generally parallel banding guide slots formed in respective outer edges thereof in mutual registration for receiving either a single banding element or a pair of banding elements for securing a mail product loaded therein.

2. A mail carrier for providing reduced handling of mail at postal facilities while supporting both manual and automated mail processing, comprising:

a substantially rigid carrier body having a rectangular cross section and having a plurality of flat, generally rectangular mutually orthogonal wall members, including three side walls and two end walls, two or more of which have one or more banding guide slots formed in respective outer edges thereof in mutual registration for receiving means for securing a mail product loaded therein, in either parallel or cross-banding arrangements, and wherein at least one of said two end walls is translatable lengthwise within the carrier body.

3. A mail carrier for providing reduced handling of mail at postal facilities while supporting both manual and automated mail processing, comprising:

a substantially rigid carrier body having a rectangular cross section and having a plurality of flat, generally rectangular mutually orthogonal wall members, including three side walls and two end walls, two or more of which have one or more banding guide slots formed in respective outer edges thereof in mutual registration for receiving means for securing a mail product loaded therein in either parallel or cross-banding arrangements, and wherein one of said two end walls is hinged to one of said side walls.

4. A mail carrier for providing reduced handling of mail at postal facilities while supporting both manual and automated mail processing, comprising:

a substantially rigid carrier body having a rectangular cross section and having a plurality of flat, generally rectangular mutually orthogonal wall members including three side walls and one end wall, an intermediate side wall of said three side walls and said one end wall having a pair of generally parallel banding guide slots formed in respective outer edges thereof in mutual registration for receiving either a single banding element or a pair of banding elements for securing a mail product loaded therein.

5. A mail carrier for providing reduced handling of mail at postal facilities while supporting both manual and automated mail processing, comprising:

a substantially rigid carrier body having a rectangular cross section and having a plurality of flat, generally rectangular mutually orthogonal wall members, including two mutually adjacent side walls and one end wall, each of said walls having one or more banding guide slots formed in respective outer edges thereof in mutual registration for receiving means and securing a mail product loaded therein in either a parallel or a cross-banding arrangement.

6. A mail carrier for providing reduced handling of mail at postal facilities while supporting both manual and automated mail processing, comprising:

a substantially rigid carrier body having a rectangular cross section and having a plurality of flat, generally rectangular mutually orthogonal wall members, including two mutually adjacent side walls and an end wall attached thereto, and wherein said two side walls include a single banding guide slot and said end wall includes two banding guide slots in adjacent side edges, one of said slots being in registration with each of said single banding guide slots for receiving respective banding elements in a cross-banding arrangement.

7. A mail carrier for providing reduced handling of mail at postal facilities while supporting both manual and automated mail processing, comprising:

a substantially rigid carrier body having a rectangular cross section and having a plurality of flat, generally rectangular mutually orthogonal wall members, including two mutually adjacent side walls and an end wall attached thereto, and wherein said two side walls include a pair of mutually parallel banding guide slots and said end wall includes two pairs of mutually parallel banding guide slots in adjacent side edges, one pair of said two pairs of slots being in registration with one pair of slots in one of said side walls and one pair of said two pairs of slots being in registration with the other pair of slots in the other side wall for receiving one or more banding elements in a parallel or cross-banding arrangement.

* * * * *